US006338654B1

(12) United States Patent
Sasaki et al.

(10) Patent No.: US 6,338,654 B1
(45) Date of Patent: Jan. 15, 2002

(54) ELECTRICAL CONNECTOR HAVING TERMINAL INCOMPLETE INSERTION RECOGNIZING STRUCTURE

(75) Inventors: Yasuhiro Sasaki; Masanori Tsuji; Tomohiko Kimura; Motohisa Kashiyama, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/592,270

(22) Filed: Jun. 12, 2000

(30) Foreign Application Priority Data

Jun. 11, 1999 (JP) ..... 11-165330

(51) Int. Cl.[7] ..... H01R 13/422
(52) U.S. Cl. ..... 439/595; 439/752
(58) Field of Search ..... 439/595, 752, 439/488

(56) References Cited

U.S. PATENT DOCUMENTS 5,586,917 A * 12/1996 Yagi et al. ..... 439/488
6,123,574 A * 9/2000 Matsuda et al. ..... 439/488

* cited by examiner

*Primary Examiner*—Gary Paumen
(74) *Attorney, Agent, or Firm*—Armstrong, Westerman, Hattori, McLeland & Naughton, LLP

(57) ABSTRACT

A connector housing has a lock arm for locking a terminal therein. The lock arm deflects in an complete insertion state of the terminal so that a spacer abuts against a side surface of the lock arm. The lock arm is formed with a projection which abuts the incompletely inserted terminal in the spacer advancing direction. The projection may be a plate piece elongated in the longitudinal direction of the lock to be pinched by a pair of a resilient contact plates of the terminal. Alternatively, the lock arm may have a protrusion engaging with an engagement hole formed in the connector housing. The protrusion is a rectangular plate extending from the fore end of the lock arm. An inclined guide surface continuos with the engagement hole may be provided in the connector housing. Alternatively, the connector housing may have an inner embossed wall positioned closely to the deflected lock arm to oppose to the spacer. A clearance between the embossed wall and the lock arm is determined within the elastic deflection limit of the lock arm.

3 Claims, 6 Drawing Sheets

ELECTRICAL CONNECTOR HAVING TERMINAL INCOMPLETE INSERTION RECOGNIZING STRUCTURE

BACKGROUND OF THE INVENTION

1. Field of the Invention

The present invention relates to an electrical connector having a structure for recognizing an incomplete insertion state of a terminal in the connector housing. A resilient lock arm is disposed in the connector housing for locking the terminal, and a spacer is inserted in the connector housing for additionally locking the terminal inserted in the connector housing. The spacer abuts against the resilient arm when the terminal is incompletely inserted in the connector housing to recognize the incomplete insertion of the terminal.

2. Related Art

Referring to FIGS. 15 and 16, there is illustrated a conventional electrical connector 90 having a terminal double locking structure. The structure has a function for recognizing an incomplete insertion state of the terminal in the connector housing.

As illustrated in FIG. 15, the terminal double locking connector 90 has a synthetic resin connector housing 91, a plurality of terminals 92 each connected to an electrical cable and upwardly inserted into the connector housing 91, and a synthetic resin spacer 97 laterally inserted into the connector housing 91 through openings of the connector housing 91. The spacer 97 has a pair of first extending bars 94 each engaging with a rear surface of a step 93 formed in a rear part of each terminal 92. The spacer 97 also has a second extending bar 95 that advances into a housing space in which a resilient lock arm 96 (FIG. 16) for each terminal deflects.

The second bar 95 of the spacer 97 has a fore end abutting against a side surface of the lock arm 96 in an incomplete insertion state of the terminal 92 (FIG. 16). In FIG. 16, the lock arm 96 is pushed by a base plate 98 of the terminal 92 to be deflected inward. In this deflected state, a fore end of the second bar 95 abuts against a side surface of the lock arm 96 when the spacer 97 (FIG. 15) is inserted. This prevents a further advance of the spacer 97, recognizing the incomplete insertion of the terminal 92. In this incomplete insertion state, the first bar 94 also has not locked the rear step 93 of the terminal 92.

However, in the conventional structure for recognizing the terminal incomplete insertion, some workers try to forcibly push further the spacer 97 to fully advance it even when the bar 95 of the spacer 97 is abutting against the lock arm 96 of the connector housing 91. Sometimes, this forcible operation has caused the lock arm 96 to deflect in a significantly curved shape in its lateral (width) direction. This has arisen a permanent deformation or damage of the lock arm 96.

SUMMARY OF THE INVENTION

In view of the above-described disadvantage, an object of the invention is to provide an electrical connector having an improved structure for recognizing an incomplete insertion state of a terminal in a connector housing. A resilient lock arm disposed in the connector housing deflects in the incomplete insertion of the terminal so that a spacer abuts against a side surface of the lock arm to restrict a further advance of the spacer for recognizing the terminal incomplete insertion. The improved structure prevents a permanent deformation and damage of the lock arm even when the spacer is forcibly pushed against the lock arm in the abutting state of the spacer against the lock arm.

For achieving the object, an electrical connector of a first aspect of the invention includes a connector housing, a resilient lock arm disposed in the connector housing for locking a terminal, a spacer sliding in the connector housing for additionally locking the terminal inserted in the connector housing, and a projection formed on the resilient arm. The spacer abuts against a side surface of the lock arm when the resilient lock arm is deflecting in an incomplete insertion state of the terminal in the connector housing for recognizing the incomplete insertion of the terminal. The projection abuts against the terminal in an advance direction of the spacer in the incomplete insertion state of the terminal. The projection may be a flat bar extending in a longitudinal direction of the lock arm. Furthermore, the projection may be sandwiched between a pair of elastic pieces fitted on the terminal.

An electrical connector of a second aspect of the invention includes a connector housing, a resilient lock arm disposed in the connector housing for locking a terminal, a spacer inserted in the connector housing for additionally locking the terminal inserted in the connector housing, a projection formed on the lock arm, and an engagement portion provided in the connector housing. The spacer abuts against the lock arm when the lock arm is deflecting in an incomplete insertion state of the terminal in the connector housing for recognizing the incomplete insertion of the terminal. The projection advances into the engagement portion by the deflection of the lock arm in the incomplete insertion state of the terminal. The projection may be formed on a fore end of the lock arm. The projection may have a shape of a rectangular flat bar. The connector housing may be formed with a guide surface continuous with the engagement portion.

An electrical connector of a third aspect of the invention includes a connector housing, a resilient lock arm disposed in the connector housing for locking a terminal received in the connector housing, and a spacer inserted in the connector housing for additionally locking the terminal inserted in the connector housing. The spacer abuts against one of a pair of side surfaces of the lock arm which is deflected in an incomplete insertion state of the terminal in the connector housing for recognizing the incomplete insertion of the terminal. The connector housing has a wall closely adjacent to the other side wall of the lock arm when the lock arm is deflecting, The wall of the connector housing being positioned in an opposite side of the lock arm to the spacer in the incomplete insertion state of the terminal. The wall of the connector housing may be an embossed wall positioned to have a clearance from the lock arm, and the clearance is smaller than an elastic deflection limit of the lock arm.

Now, operational effects of the present invention will be discussed. As described above, in the first aspect of the invention, when the terminal is incompletely inserted, the lock arm deflected by the terminal abuts against the leading end of the spacer at the side surface of the lock arm. This prevents a further advance of the spacer, recognizing the incomplete insertion of the spacer. At the same time, the projection of the lock arm abuts against the terminal in the spacer insertion direction, preventing the lock arm from deflecting laterally (perpendicular to the normal deflection direction). Thereby, this eliminates a permanent deformation, damage, etc. of the lock arm. The lock arm prevented from deflecting the spacer advancing direction allows a more reliable recognition of the terminal incomplete insertion. The elongated projection has an increased area to abut against the terminal, decentralizing the pushing force exerted by the spacer. This eliminates a permanent deformation, damage, etc. of the terminal and the elongated projection. The lock arm prevented from deflecting is laterally allows a more reliable recognition of the terminal incomplete insertion.

The first aspect of the invention applies an existing shape for the resilient electrical contact piece to abut against the projection of the lock arm. No new abutting portion of the terminal against the projection is required, which is advantageous in time and cost. The resilient contact piece receives resiliently the force acted on the spacer, preventing a permanent deformation, damage, etc. of the projection and the spacer.

In the second aspect of the invention, when the terminal is incompletely inserted, the locking arm deflected by the terminal engages the projection of the lock arm with the engage portion of the connector housing. Thereby, the lock arm is retained stably at each end thereof, that is, at the root portion and at the protrusion. Thus, even when the spacer abuts against a side surface of the lock arm, the lock arm does not deflect laterally, preventing a permanent deformation, damage, etc. of the lock arm. The deformation limitation of the lock arm in the spacer insertion direction allows a more reliable recognition of the incomplete insertion of the terminal. In the complete insertion state of the terminal, the resiliency of the lock arm causes the protrusion advanced in the engagement portion to disengage from the engagement hole, and the lock arm locks surely the terminal. In addition, the present invention prevents the lateral deflection of the terminal regardless of the shape of the terminal. Furthermore, in an additional aspect of the invention, the lock arm is retained at each end, that is, at the free fore end and at the root portion of the lock arm. This increases significantly the lateral rigidity of the lock arm against a lateral bending force, preventing a lateral deformation of the lock arm to allow a more reliable recognition of the incomplete insertion of the terminal. Moreover, since the plate protrusion deflects in its thickness direction, the protrusion can engage with and disengage from the engagement portion with ease, preventing a permanent deformation, damage, etc. of the protrusion. In addition, the protrusion advances into the engagement portion along the inclined guide surface and disengage from the engagement portion along the inclined guide surface. This allows smooth, reliable engagement and disengagement thereof.

In the third aspect of the invention, when the terminal is incompletely inserted, the lock arm deflected by the terminal abuts against the leading end of the spacer at the side surface of the lock arm. This causes the other side surface of the lock arm to abut against the embossed wall of the connector housing, so that the lock arm does not deflect laterally, preventing a permanent deformation, damage, etc. of the lock arm. The limited deformation of the lock arm in the spacer insertion direction allows a more reliable recognition of the incomplete insertion of the terminal. Particularly, the direct abutment of the side surface of the lock arm against the embossed wall prevents surely the lateral deformation of the lock arm. In addition, the embossed wall is used also as an inner wall for retaining the terminal, reducing the accommodation chamber in manufacturing cost. Moreover, regardless of the shape of the terminal, the lateral deflection of the lock arm is prevented.

DETAILED DESCRIPTION OF THE PREFERRED EMBODIMENTS

Referring to the accompanied drawings, embodiments of the present invention will be discussed in detail.

Figure 1:
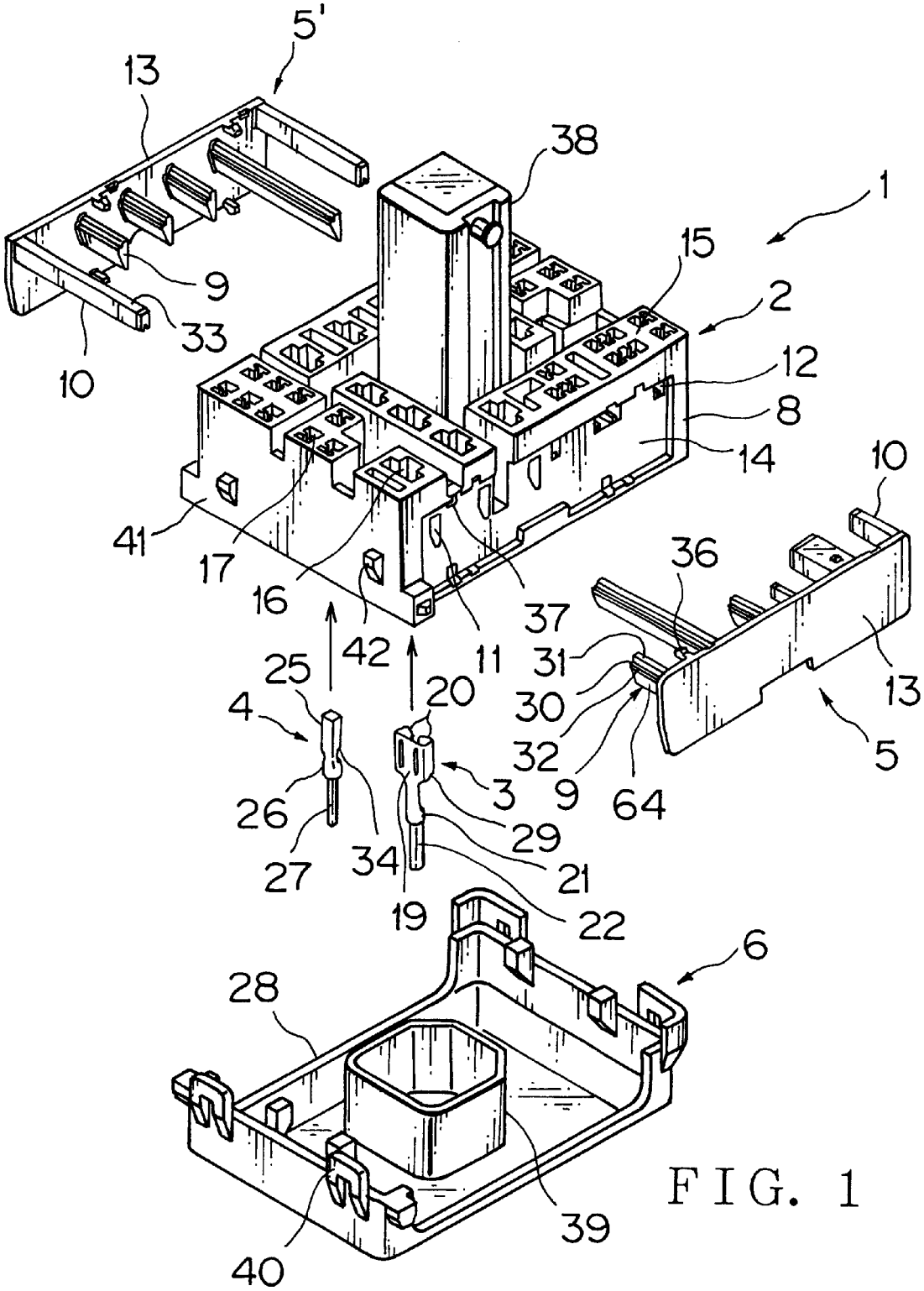
FIG. 1 is an exploded perspective view showing an embodiment of a terminal double locking connector having structure for recognizing an incomplete insertion state of a terminal.

FIG. 1 is a perspective view showing an embodiment of a terminal double locking connector 1 according to the present invention. The connector 1 includes a structure for recognizing an incomplete insertion state of a terminal.

The double locking connector 1 has a plug-type connector housing 2 made of a synthetic resin material, receptacle-type terminals 3, 4 each connected to an electrical cable, a terminal locking spacer 5 made of a synthetic resin material, and a bottom cover 6 also made of a synthetic resin material.

The connector housing 2 has a plurality of larger and smaller terminal accommodation chambers 7 (FIG. 2) and has each side wall 8 formed with a plurality of insertion holes 11, 12 for receiving a plurality of extending bars 9, 10 of a spacer 5 or 5'. The side wall is also formed with a recess 14 for receiving a base plate 13 of the spacer 5 or 5'. In the complete insertion state of the spacer 5 or 5', the base plate 13 engages the recess 14, in which an outer surface of the base plate 13 and an outer surface of the side wall 8 of the connector housing 2 are flush with each other.

Figure 3:
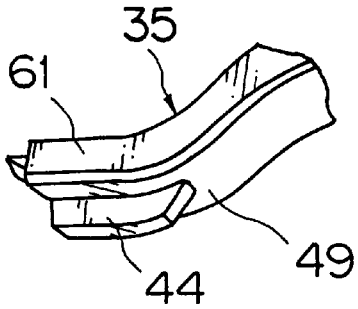
FIG. 3 is a perspective view showing a lock arm.

The connector housing 2 has an engage face (a fore face) 15 opposing to an associated female connector housing (not shown). The engage face 15 is provided with a plurality of larger and smaller insertion openings 16, 17 for receiving pin-type terminals (not shown). Each insertion opening 16 or 17 is continuous with each terminal accommodation chamber 7 (a terminal accommodation chamber continuous with the insertion opening 17 is not shown). The receptacle-type terminals 3, 4 are received in associated accommodation chambers 7 through openings 18 formed a housing rear face opposed to the engage face 15 (only an opening 18 associated with the terminal 3 is illustrated in FIG. 3).

The larger receptacle-type terminal 3 includes a base plate portion 19 of which a fore half has an increased width. The fore half is formed with a pair of curled resilient contact plates 20 respectively positioned at each side thereof. The rear half of the base plate portion 19 has a reduced width and includes a wire connection portion 21.

Figure 2:
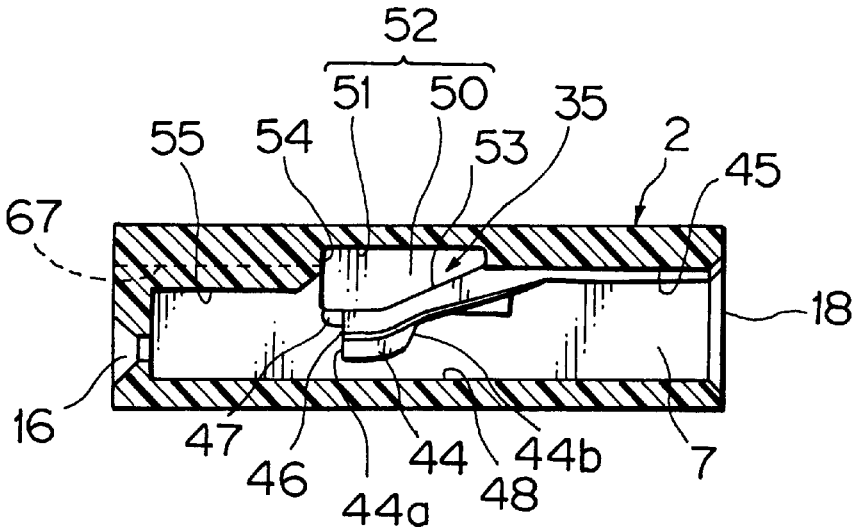
FIG. 2 is a longitudinal sectional view of a connector housing related to a first embodiment of a structure for recognizing an incomplete insertion state of a terminal.

An exposed conductor portion of the electrical wire 22 is crimped by a fore side crimping piece 23 (FIG. 2), and an insulated portion of the electrical wire 22 is crimped by a rear side crimping piece 24 (FIG. 2). The smaller receptacle-type terminal 4 has a box-shaped electrical contact portion 25 at one side thereof and has a wire connection portion 26 at the other side. The electrical wires 22, 27 are led out externally through a side opening 28 of the cover 6 which has been mounted on the connector housing 2.

Each spacer 5 or 5' consists of the base plate 13 and a plurality of extending bars 9, 10 perpendicular to the base plate 13. The bars 9, 10 are different from each other in length and in shape. The bar 9 has a generally wedge-shaped section and has a vertical width comparatively larger as corresponding to the larger terminal 3. In an upper part of the bar 9, there is formed a step 30. A top surface 31 of the bar 9 is defined to contact an inner surface of the insertion hole 11 of the connector housing 2, and a horizontal face 32 of the step 30 is defined to engage with a rear shoulder 29 of the terminal 3. A resilient lock arm 35 (FIG. 2) formed in the connector housing 2 locks the terminal 3 to be retained therein.

The bar 10 which is associated with the smaller terminal 4 has an upper end surface 33 abutting against a rear step 34 of the terminal 4, that is, against a shoulder positioned in the rear side of an electrical connection portion 25 of the terminal 4. Thus, each terminal 3, 4 is prevented from unintentionally being drawn out. Each terminal 3, 4 is locked first by the resilient lock arm 35 (FIG. 2) of the connector housing 2. It is noted that the vertical direction defined of FIG. 1 does not limit the positioning in practical use of the connector 1, and the fore and rear directions of the connector 1 are defined based on the insertion directions of the terminals.

The base plate 13 of each spacer 5 or 5' has a latch hook 36 for the connector housing 2 while the receiving recess 14 of the connector housing 2 has a lock hole 37 engaging with the hook 36. The hook 36 prevents the spacer 5 or 5' from unintentionally being drawn out.

The connector housing 2 has a center column 38 upwardly extending therefrom. The column 38 provides a mating guide for an associated female-type connector housing (not shown). The cover 6 has an engagement guide frame 39 for the column 38 at the central portion thereof and has a couple of lock frames 40 at each side thereof. The lock frames 40 engage with locking protrusions 42 formed on walls 41 perpendicular to the housing side walls 8 opposing to the spacers. The cover 6 protects the rear side (a wire leading-out side) of the connector housing 2.

Next, embodiments of the connector 1 having an inner structure for recognizing the terminal incomplete insertion according to the present invention will be discussed. Note that the reference numerals used in the connector 1 shown in FIG. 1 are applied to each embodiment and the longitudinal and lateral directions of FIG. 1 are common to drawings of each embodiment.

FIGS. 2 to 6 show a first embodiment of a structure for recognizing an incomplete insertion state of a terminal. In this structure, a resilient lock arm 35 of the connector housing 2 has a flat bar projection (projection) 44. The projection 44 can be positioned between a pair of resilient plates 20 constituting the electrical contact portions 20 of the receptacle-type 3 (FIG. 4) inserted in the terminal accommodation chamber 7 of the connector housing 2. The projection 44 is engaged with the pair of resilient plates 20. The projection 44 retained between the pair of resilient plates specifically prevents the lock arm 35 from undesirably deflecting in its lateral direction when the fore end of the extending bar 9 (FIG. 6) of the spacer 5 (FIG. 1) abuts against the lock arm 35.

As illustrated in FIG. 2, the lock arm 35 is extending diagonally forward from an inner wall 45 of a rear half side of the terminal accommodation chamber 7. A fore portion of the lock arm 35 is formed generally parallel to the inner wall 45. The lock arm 35 has a lateral width $L_1$ (FIG. 6) that is around one third of the width of the terminal accommodation chamber 7. The lock arm 35 has a fore end surface 46 positioned within a fore half of the terminal accommodation chamber 7, and from the fore end surface 46, a short projection 47 is extending forward. In complete insertion of the terminal 3, the fore end surface 46 of the lock arm 35 and the fore end of the projection 44 abut against rear end portions of the pair of resilient contact plates 20 of the terminal 3 (FIG. 5), and the fore projection 47 abuts against a top surface of the resilient contact plates 20. The terminal 3 may have an engagement hole (not shown) associated with the projection 44.

As illustrated in FIG. 3, the lock arm 35 has the projection 44 unitarily formed on its fore side wall 49 opposing to a lower inner wall 48 of the connector housing 2. The projection 44 is extending from a fore end to a middle of the locking arm 35 in a flat bar shape.

As illustrated in FIG. 2, in a released state of the lock arm 35, the fore end **44*a* of the projection 44 is perpendicular to the inner wall 48 of the connector housing 2, and a rear end of the projection 44 has a tapered guide surface 44*b* which allows a smooth slidable contact with the terminal 3. The projection 44 has a thickness $T_1$ (FIG. 6) smaller than the lateral width of the fore projection 47 and has a downward projecting dimension a little across a center line of the insertion opening 16 of the terminal accommodation chamber 7**.

The connector housing 2 includes a space 50 for allowing a deflection of the lock arm (hereinafter called as the deflection space) and a spacer insertion channel 51 continues with the deflection space 50. The channel 51 is defined in a rectangular shape by cutting off the inner wall 45 of the connector housing 2. The spacer insertion channel 51is extending perpendicular to the terminal insertion direction. The spacer insertion channel 51 and a part of the deflection space 50 constitute a spacer receiving space 52. The spacer receiving space 52 is continuous with the spacer insertion opening 11. In the spacer receiving space 52, the extending bar 9 (FIG. 6) having a wedge-shaped section of the spacer 5 (FIG. 1) is inserted. The spacer insertion channel 51 is opposing to an upper surface 53 of the lock arm 35 and has a width not larger than the length of the lock arm 35. The foremost end of the projection 47 of the lock arm 35 is generally in the same plain as a fore end of the spacer insertion channel 51, and the lock arm 35 has a root portion near a rear end of the spacer insertion channel 51.

One inner wall 55 provided in a fore half of the terminal accommodation chamber 7 has each side part lower than the inner wall 45 positioned in the rear half. Thereby, between the one inner wall 55 and the other wall 48 (bottom wall), the resilient contact plate 20 of the terminal 3 is received with almost no clearance.

Figure 4:
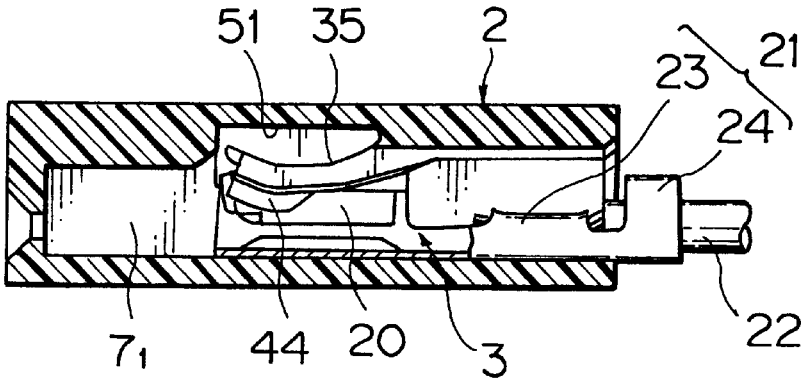
FIG. 4 is a longitudinal sectional view showing the connector housing with a terminal halfway inserted therein.
Figure 5:
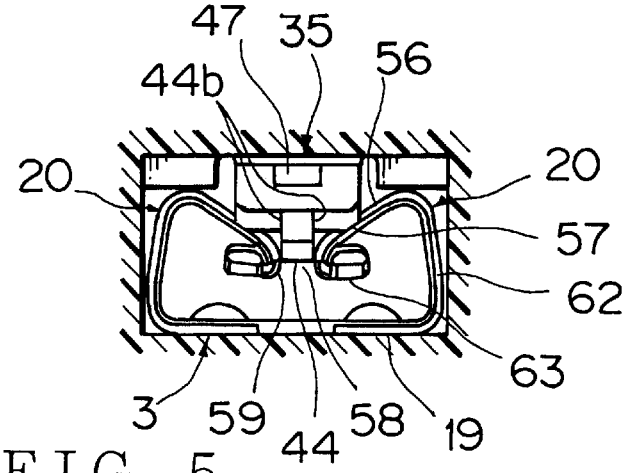
FIG. 5 is a front view illustrating a state in which a flat-bar projection of the lock arm is engaged with the terminal.

When the accommodation chamber 7 (FIG. 2) receives the terminal 3 through the rear opening 18, the resilient contact plate 20 of the terminal 3 depresses the lock arm 35 to deflect it toward the spacer insertion channel 51 as illustrated in FIG. 4. That is, as illustrated in FIG. 5, each inclined surface 56 of the resilient contact plates 20 slidingly abuts against each corner 57 of the lock arm 35. Thereby, as illustrated in FIG. 5, the lock arm 35 deflects upward toward the spacer insertion channel 51 (FIG. 4).

At the same time, the projection 44 of the lock arm 35 advances into a clearance 58 between the pair of the resilient contact plates 20. Each side surface 44*b* of the projection 44 contacts an inner end 59 of each resilient contact plates 20 with no gap therebetween. The inclined guide surface 44*b* (FIG. 2) formed at a rear end portion of the projection 44 slidably contacts the fore end of the resilient contact plates 20 to advance smoothly into the clearance 58. Finally, the lock arm 35 returns back by its resiliency to rest on the resilient contact plates 20 and the projection 44 is fully engaged within the clearance 58.

Note that the thickness $T_1$ of the projection 44 may be larger than the clearance 58 of the pair of resilient contact plates 20. The larger thickness projection 44 is forcefully engaged in the clearance 58 to be pinched by the pair of resilient contact plates 20. The projection 44 abuts against the pair of resilient contact plates 20 with no looseness therebetween. FIGS. 4, 5 show a state in which the terminal is in a half way of the insertion or is incompletely inserted.

Figure 6:
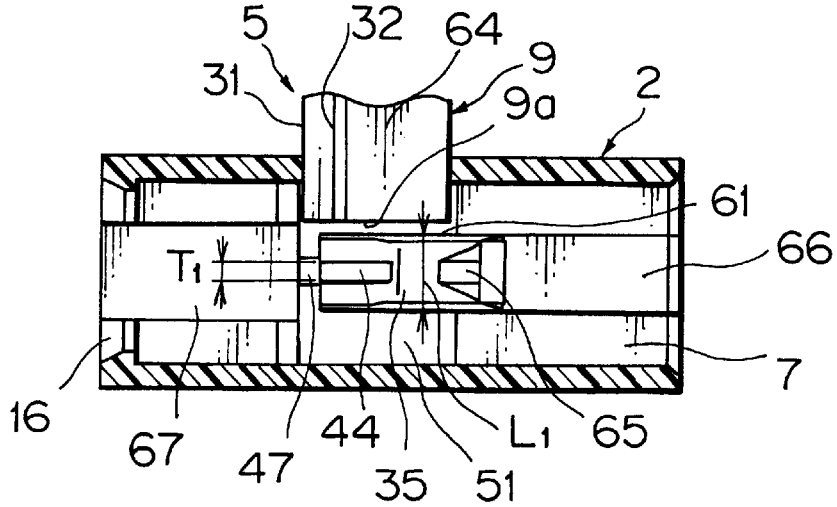
FIG. 6 is a cross-sectional view illustrating a state in which a spacer is inserted toward the lock arm.

In an incomplete insertion state of the terminal 3, when the spacer 5 is inserted as illustrated in FIG. 6, a fore end 9*a* of the extending bar 9 will abut against a side surface 61 of the lock arm 35 not to allow a further advancement of the spacer 5. In this state, the projection 44 of the lock arm 35 is abutting against the inner end 59 of each resilient contact plates 20 as illustrated in FIGS. 4 and 5. Thus, a further forcible insertion force of the spacer 5 would act on one of resilient contact plates 20 through the projection 44, preventing an excessive lateral bending deflection of the lock arm 35. The resilient contact plates 20 of the larger terminal 3 provide a larger reaction force, so that a forceful insertion force of the spacer 5 would causes only a little elastic lateral deflection of the resilient contact plates 20 with no problem.

As illustrated in FIG. 5, each resilient contact plate 20 of the lock arm 3 consists of a rising portion 62 rising almost perpendicularly from each side of the base plate 19, an inwardly inclined portion 56 downward inclined from the rising portion 62, and a contact plate portion 63 turned back from the inclined portion 56 to be generally parallel with the base plate 19. A bent between the inclined portion 56 and the contact plate portion 63 constitutes the inner end portion 59. The pair of inner end portions 59 of the resilient contact plates 20 receive the projection 44 of the lock arm 35 therebetween.

Further pushing forward the terminal 3 in the half inserted state illustrated in FIG. 4 allows the resilient contact plates 20 (that is, the electrical contact portions) of the terminal 3 to be completely received in a fore space 71 of the accommodation chamber 7. The lock arm 35 is released from the biasing force of the resilient contact plates 20 to resiliently return to the state illustrated in FIG. 2, which locks a rear end of the resilient contact plates 20.

The lock arm 35 returned to the state of FIG. 2 allows the extending bar 9 of the spacer 5 (FIG. 6) to advance into the spacer receiving space 52 (FIG. 2) with no interference with the lock arm 35. The extending bar 9 advances into the lock arm deflection space 50. The terminal 3 has been locked by the lock arm 35. The inclined surface 64 (FIG. 1) of the extending bar 9 contacts with the upper surface 53 (FIG. 2) of the lock arm 35, preventing the deflection of the lock arm 35.

It is noted that the projection 44 of the lock arm 35 may be configured to lock the smaller receptacle terminal 4 illustrated in FIG. 1. In this case, the box-shaped electrical contact portion 25 of the terminal 4 may have an insertion slit (not shown) for receiving the projection 44, and the projection 44 may have a thickness smaller than the terminal 3. In FIG. 6, denoted 65 is a rib formed on a root portion of the lock arm 35, 66 an embossed wall of the connector housing 2 which is continues with the root portion of the lock arm 35, and 67 a passage extending toward a fore opening 16 of the connector housing 2 for drawing out a molding die for the lock arm.

Figure 7:
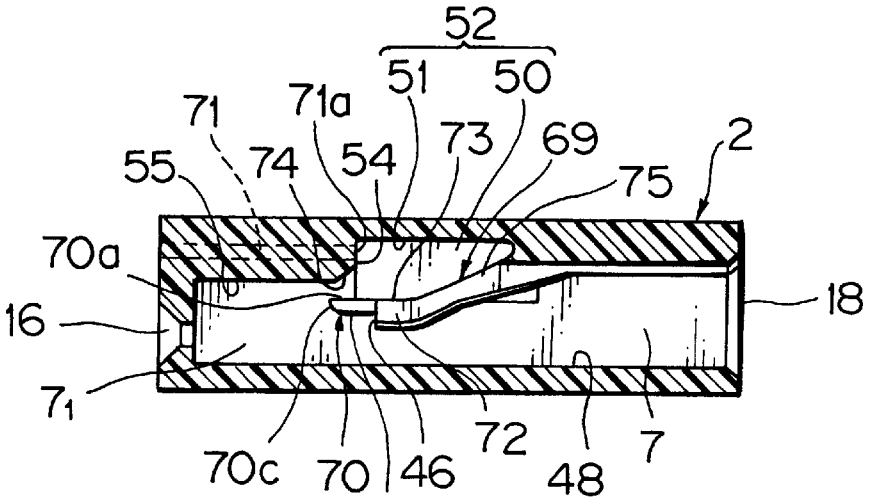
FIG. 7 is a longitudinal section view of a connector housing related to a second embodiment of a structure for recognizing an incomplete insertion state of a terminal.
Figure 8:
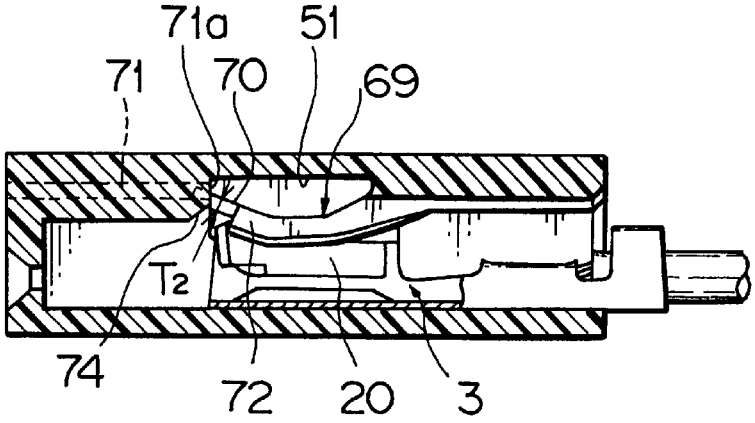
FIG. 8 is a longitudinal sectional view showing a state in which a projection of a lock arm is engaged with an engagement hole of a connector housing.
Figure 9:
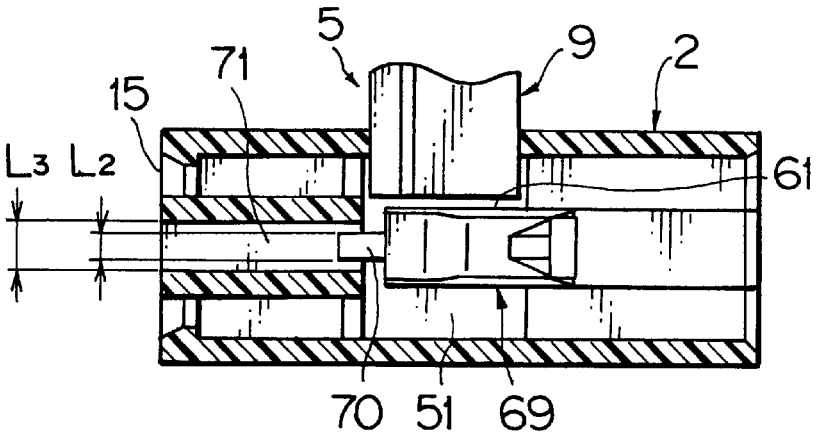
FIG. 9 is a sectional view illustrating a state in which a spacer is inserted toward the lock arm.

FIGS. 7 to 9 show a second embodiment of a structure for recognizing an incomplete insertion state of a terminal. The same component as the first embodiment, which will not be discussed again, has the same reference numeral.

In this structure, a resilient lock arm 69 formed in the connector housing 2 has an elongated protrusion 70 at the fore end 46 thereof. Meanwhile, the connector housing 2 has a hole 71 (engagement portion) engaging with the protrusion 70 in the side of the receiving space 50 of the lock arm 69. Thus, in the incomplete insertion state of the terminal 3 (FIG. 8), the protrusion 70 engages with the hole 71, preventing the lock arm 69 from laterally deflecting by the spacer 5 (FIG. 9) pushed forward.

As illustrated in FIG. 7, in the released state of the lock arm 69, the protrusion 70 is extending across the fore end surface 54 of the spacer insertion channel 51, and the rear end of the protrusion 70 (that is, the fore end surface 46 of the lock arm 69) is positioned a little rearward from the fore end surface 54 of the spacer insertion channel 51. A longitudinally middle point of the protrusion 70 is positioned approximately in the same plain as the fore end surface 54 of the spacer insertion channel 51.

A fore side portion 72 of the lock arm 69 is parallel with the inner wall 48 of the terminal accommodation chamber 7, and the protrusion 70 is extending straight in the same direction as the fore side portion 72. The upper surface 73 of the fore side portion 72 is flush with an upper surface 70a of the protrusion 70, and a lower surface 70*b* of the protrusion 70 is positioned generally at a haft height of the fore end surface 46 of the lock arm 69. The protrusion 70 has a generally arc-shaped surface 70*c* continues with the lower surface 70*b*. The arc-shaped surface 70*c* allows an easy release of the protrusion 70 from the engagement channel 71. In place of the arc-shaped surface 70*c*, a tapered surface (not shown) may be provided.

The protrusion 70 has a thickness $T_2$ of generally a half of the fore side portion 72 of the lock arm 69 and has a lateral width $L_2$ of generally one third of the width of the lock arm 69 as illustrated in FIG. 9. The protrusion 70 is a rectangle flat bar. The protrusion 70 has a resiliency in its thickness direction. This construction of the protrusion 70 allows its easy release from the engagement channel 71. Preferably, the protrusion 70 has a structure not to deflect in its lateral width direction.

In FIG. 7, the fore end 46 of the lock arm 69 is facing toward the spacer insertion channel 51 nearer a center line of the fore opening 16 for inserting an opposing associated terminal in the same way as the first embodiment. The protrusion 70 is also facing toward the spacer insertion channel 51.

The spacer insertion channel 51 continues with the receiving space 50 for deflecting the lock arm 69 is defined in a rectangular shape. In the fore end side of the spacer insertion channel 51, an inner wall 55 of the fore part 71 of the accommodation chamber 7 is formed with a tapered corner to provide a guide surface 74 for the protrusion 70.

The fore end 54 of the spacer insertion channel 51 is formed with an engagement hole 71 for the protrusion 70. The engagement hole 71 is adjacent to the guide surface 74 and extending in the terminal insertion direction. The engagement hole 71, as also illustrated in FIG. 9, is a through hole opened at the fore end surface 15 of the connector housing 2. This through hole is provided for drawing out a molding die in resin injection molding. In place of the through hole 71, there may be provided a blind hole (engagement channel). Preferably, the blind hole (not shown) has a depth longer than the protrusion 70.

An entrance 71*a* of the engagement hole 71 is continuous with the inclined guide surface 74 and is a little apart from a wall (denoted 51) of the spacer insertion channel 51 toward the inclined guide surface 74. As illustrated in FIG. 9, the engagement hole 71 has a lateral width $L_3$ a little larger than the lateral width $L_2$ of the protrusion 70, so that the protrusion 70 can smoothly advance into the engagement hole 71 even when the lock arm 69 is slightly laterally displaced form its normal position. A lateral clearance $((L_3-L_2/2)$ between the engagement hole 71 and the protrusion 70 is determined within the elastic deformation limit of the lock arm 69. In the state illustrated in FIG. 7, the connector housing 2 receives the terminal 3 (FIG. 8) in the accommodation chamber 7 through the rear opening 18. As illustrated in FIG. 8, during the insertion of the terminal 3 (an half inserted state), the lock arm 69 is pushed upward by the advancing terminal 3, so that the fore side portion 72 with the protrusion 70 of the lock arm 72 is bent upward (in a diagonal direction toward the spacer insertion channel 51). This results from that the lock arm 69 in the released condition illustrated in FIG. 7 is inclined diagonally downward with the fore side portion 72 being horizontal.

The lock arm 69 is bent upward at the incline portion 75 along a surface of the resilient contact plate 20 of the terminal 3 (FIG. 3). Thereby, the fore side portion 72 of the lock arm 69 rises upward as illustrated in FIG. 8. Thus, the protrusion 70 advances into the hole 71 along the inclined guide surface 74. The entrance 71*a* of the hole 71 may have a tapered guide surface increased in diameter for an easy insertion of the protrusion 70.

The engagement of the protrusion 70 with the hole 71 supports the free end of the lock arm 69, increasing the lateral bending rigidity of the lock arm 69. Thus, as illustrated in FIG. 9, when the extending bar 9 of the spacer 5 advances into the insertion channel 51 to abut against a side surface 61 of the lock arm 69, the lock arm 69 is prevented from a lateral deformation thereof. Therefore, the incomplete insertion of the terminal 3 (FIG. 8) is reliably recognized.

The terminal 3 in the state illustrated in FIG. 8 is pushed further to be completely inserted. In the complete insertion state, the resiliency of the lock arm 69 disengages the protrusion 70 from the hole 71, so that the lock arm 69 returns to the position illustrated in FIG. 7 to lock the rear end side of the resilient contact plate 20 of the terminal 3. During the disengagement of the protrusion 70, the arc-shaped surface 70*c* of the protrusion 70 slides smoothly on an end periphery of the hole 71, allowing an easy disengagement thereof. Even when the protrusion 70 is rigid in its thickness direction, the flexible lock arm 69 enables an easy disengagement of the protrusion 70. The spacer 9 does not interrupt with the lock arm 69 to be completely inserted into the receiving space 52, achieving the double lock of the terminal 3.

The terminal 3 of the second embodiment is a larger receptacle-type one the same as the first embodiment. However, in the second embodiment, the smaller terminal 4 illustrated in FIG. 1 may be applied with no modification of the box-shaped electrical contact portion 25.

FIGS. 10 to 14 show a third embodiment of a structure for recognizing an incomplete insertion state of a terminal. The same component as the first embodiment, which will not be discussed again, has the same reference numeral.

In this structure, there is provided an embossed wall (wall portion) 78 formed in the connector housing 2 laterally adjacent to a resilient lock arm 77. In an incomplete insertion state of the terminal 3 (FIG. 12), when the spacer 5 (FIG. 14) pushes a side surface 61 of the lock arm 77, the lock arm 77 abuts against the embossed wall 78, preventing the lock arm 77 from deflecting laterally.

Figure 10:
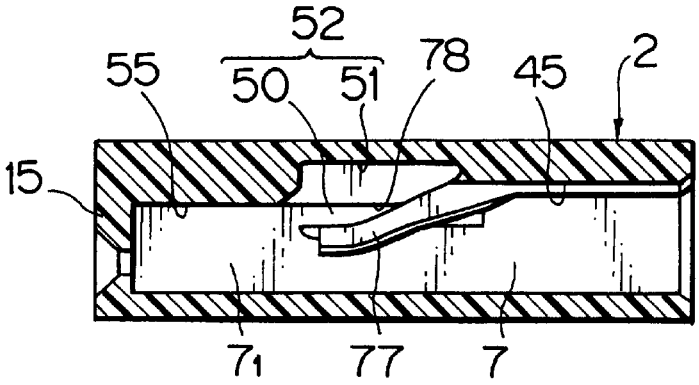
FIG. 10 is a longitudinal section view of a connector housing related to a third embodiment of a structure for recognizing an incomplete insertion state of a terminal.
Figure 11:
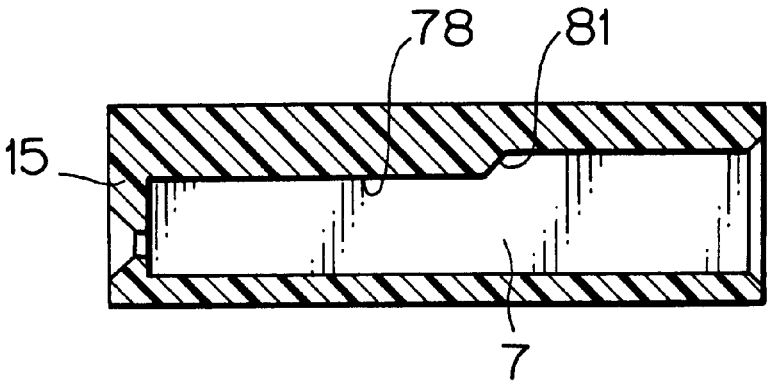
FIG. 11 is a longitudinal sectional view of the connector housing with an embossed wall.
Figure 13:
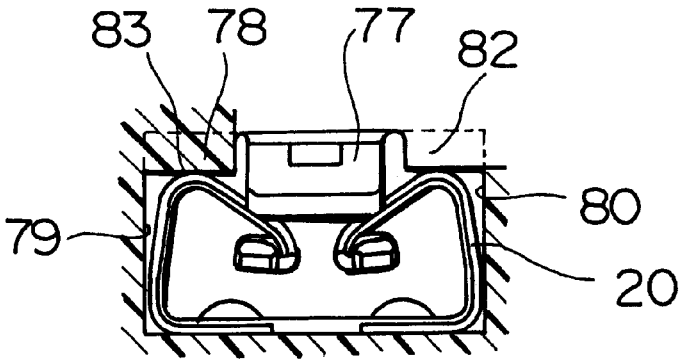
FIG. 13 is a front view illustrating a lock arm and the embossed wall, in which the lock arm is deflected by a pushing force of the terminal.

As illustrated in FIG. 10, the lock arm 77 is extending diagonally forward from a rear side inner wall 45 of the terminal accommodation chamber 7 of the connector housing 2 in the same way as the first and second embodiments. The embossed wall 78, as illustrated in FIGS. 11 and 13, is positioned at the same height as the bottom plane of the spacer inserting channel 51 (FIG. 10) and is longitudinally extending in the accommodation chamber 7 from the fore end wall 15 of the connector housing 2 to a rear end side of the spacer insertion channel 51. The embossed wall 78 is positioned at the same height as the inner wall 55 of the fore accommodation portion 71 of the accommodation chamber 7. Thus, the embossed wall 78 is also a part of the inner walls of the terminal accommodation chamber 7 to partly retain the resilient contact plate 20 of the terminal 3.

Figure 14:
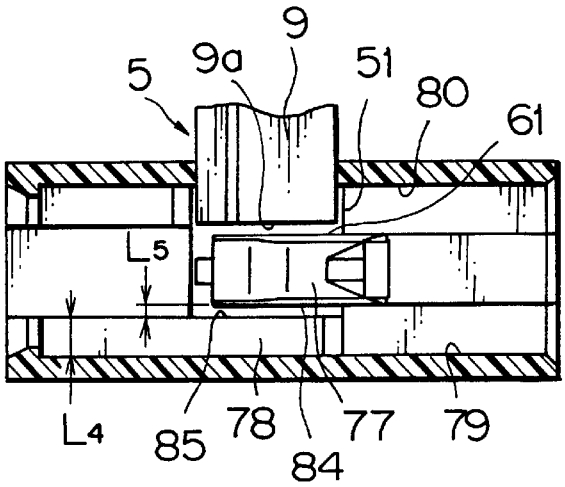
FIG. 14 is a sectional view illustrating a state in which a spacer is inserted toward the lock arm.
Figure 16:
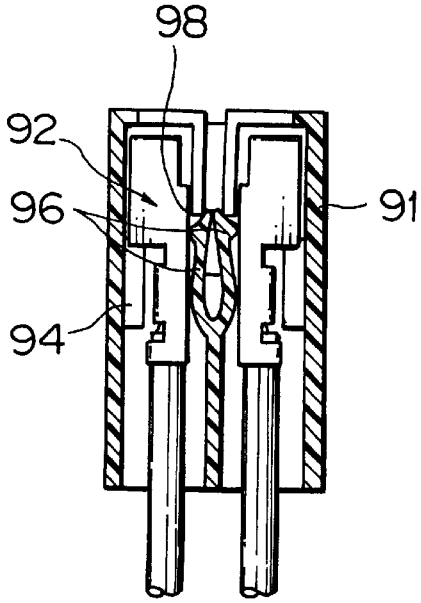
PRIOR ART FIG. 16
FIG. 16 is a longitudinal sectional view showing a connector housing of FIG. 15 with a terminal halfway inserted therein.
Figure 15:
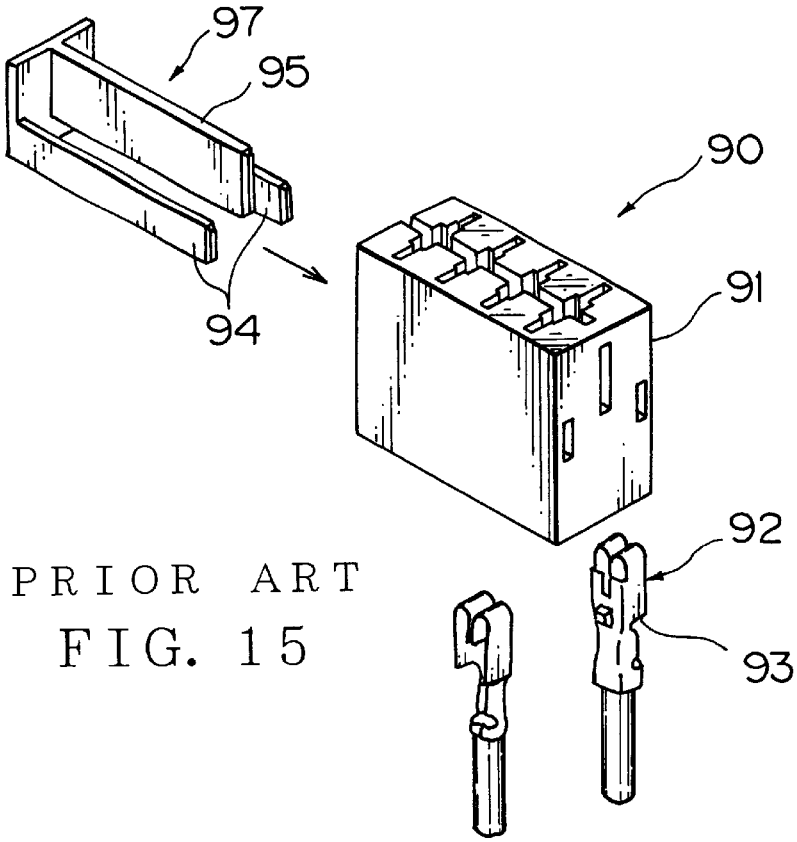
PRIOR ART FIG. 15
FIG. 15 is an exploded perspective view showing a conventional terminal double locking connector.

The terminal accommodation chamber 7 has a side wall 80 (FIG. 13) formed with the spacer insertion channel 51 continuous with the spacer insertion opening 11. The embossed wall 78 has a rear end provided with a tapered guide surface 81 (FIG. 11) along which the terminal advances smoothly. As illustrated in FIG. 14, the embossed wall 78 is projecting laterally from the inner wall 79 by a distance L4 smaller than the lateral width of the lock arm 77. As illustrated in FIG. 13, opposed to the embossed wall 78, a wall 82 is formed on the opposite side wall 80 similarly to the embossed wall 78. The wall 82 is formed with the spacer insertion channel 51 (FIG. 14). The embossed wall 78 and the wall 82 (FIG. 13) each contact a top portion 83 of the pair of the resilient contact plates 20 at each side of the terminal 3.

Figure 12:
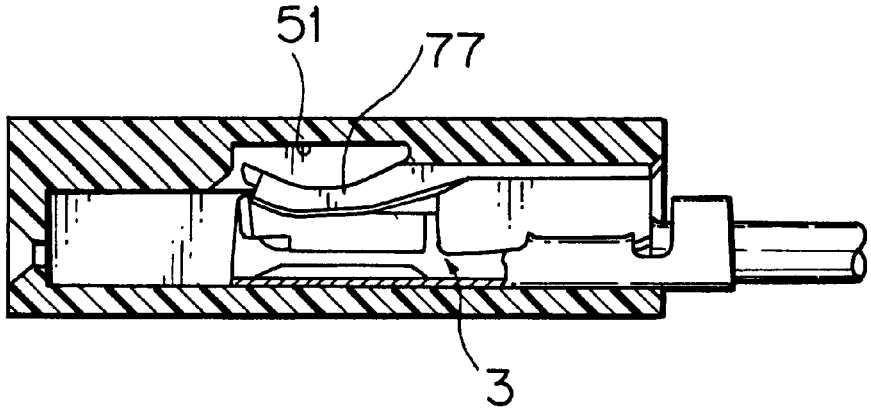
FIG. 12 is a longitudinal sectional view showing the connector housing with a terminal halfway inserted therein.

As illustrated in FIGS. 12 to 14, in an incomplete insertion state of the terminal 3, the lock arm 77 deflects into the spacer insertion channel 51 and the side surface 84 of the lock arm 77 is closely opposed to the side surface 85 of the embossed wall 78. In this state, there is a small clearance L5 between the lock arm 77 and the embossed wall 78. The clearance L5 limits the deflection of the lock arm 77 within its elastic range.

When the spacer insertion space 52 (FIG. 10) receives the extending bar 9 of the spacer 5 (FIG. 14), the leading end 9*a* of the extending bar 9 abuts against the side surface 61 of the lock arm 77 to push the lock arm 77 laterally. Then, the other side surface 84 of the lock arm 77 abuts against the side surface 85 of the embossed wall 78, preventing the lock arm 77 from deflecting laterally.

In the complete insertion state of the terminal 3, the locking arm 77 returns to the position of the FIG. 10 to lock the resilient contact plate 20 of the terminal 3. The spacer 5 advances into the spacer receiving space 52 with no interruption with the lock arm 77. The third embodiment may apply the terminal 4 having the box-shaped electrical contact portion 25 as described in the second embodiment. It is noted that the first to third embodiments may be applied not only to the connector 1 illustrated in FIG. 1 but also, for example, to a typical connector (not shown) provided on an end of a wiring harness.

What is claimed is:

1. An electrical connector comprising:

a connector housing, a resilient lock arm disposed in said connector housing for locking a terminal, a spacer sliding in said connector housing for additionally locking the terminal inserted in said connector housing, said spacer abutting against a side surface of said lock arm when the resilient lock arm is deflected in an incomplete insertion state of the terminal into said connector housing for recognizing the incomplete insertion of the terminal, and a projection formed on said resilient lock arm, wherein the projection is pushed against the terminal during spacer insertion in the incomplete insertion state of the terminal.

2. The connector set forth in claim 1, wherein said projection is a flat bar extending in a longitudinal direction of said lock arm.

3. The connector set forth in claim 1, wherein said projection is sandwiched between a pair of elastic pieces on said terminal.

* * * * *